US005791519A

United States Patent [19]

Van Marcke

[11] Patent Number: 5,791,519

[45] Date of Patent: Aug. 11, 1998

[54] SOAP BAG

[75] Inventor: Karel Carl Van Marcke, Kruishoutem, Belgium

[73] Assignee: International Sanitary Ware Manufacturing CY, S.A., Belgium

[21] Appl. No.: 580,425

[22] Filed: Dec. 27, 1995

[51] Int. Cl.[6] ..... B67D 5/00

[52] U.S. Cl. ..... 222/82; 222/83; 222/107

[58] Field of Search ..... 222/82, 83, 88, 222/95, 105, 107, 382

[56] References Cited

U.S. PATENT DOCUMENTS

| | | | |
|---|---|---|---|
| 3,035,737 | 5/1962 | Speas | 222/82 |
| 3,455,487 | 7/1969 | Crippen et al. | 222/76 |
| 3,974,942 | 8/1976 | Gray et al. | 222/88 |
| 4,008,830 | 2/1977 | Meshberg | 222/95 |
| 4,008,831 | 2/1977 | Vidilles | 222/95 |
| 4,261,356 | 4/1981 | Turner et al. | 128/214 R |
| 4,316,555 | 2/1982 | Smith | 222/83.5 |
| 4,335,833 | 6/1982 | Arabian | 222/23 |
| 4,484,697 | 11/1984 | Fry, Jr. | 222/95 |
| 4,527,716 | 7/1985 | Haas et al. | 222/83.5 |
| 4,863,066 | 9/1989 | Uffenheimer et al. | 222/1 |
| 4,938,421 | 7/1990 | Berfield et al. | 239/309 |
| 4,946,072 | 8/1990 | Albert et al. | 222/105 |
| 4,956,883 | 9/1990 | Lane | 4/605 |
| 4,998,850 | 3/1991 | Crowell | 406/48 |
| 5,004,158 | 4/1991 | Halem et al. | 239/310 |
| 5,046,648 | 9/1991 | Herbstzuber | 222/638 |
| 5,178,300 | 1/1993 | Haviv et al. | 222/95 |
| 5,188,261 | 2/1993 | Butters | 222/107 |
| 5,195,655 | 3/1993 | Bukhman | 222/1 |
| 5,215,216 | 6/1993 | Van Marcke | 222/1 |
| 5,251,787 | 10/1993 | Simson | 222/95 |
| 5,497,909 | 3/1996 | Wirsig et al. | 222/82 |

FOREIGN PATENT DOCUMENTS

| | | | |
|---|---|---|---|
| 921819 | 2/1973 | Canada . | |
| 3529659 | 2/1987 | Germany | 222/82 |
| 1224592 A | 4/1984 | U.S.S.R. . | |
| 623087 | 5/1949 | United Kingdom . | |

*Primary Examiner*—Philippe Derakshani
*Attorney, Agent, or Firm*—Cahill, Sutton & Thomas P.L.C.

[57] ABSTRACT

A source of liquid soap for washbasins and the like is provided by a flexible, collapsible bag filled with liquid soap. A hollow needle is penetrably inserted through the material of the bag, which penetration develops a seal about the needle. The needle is connected through a conduit to a dispenser for the soap. A source of vacuum in communication with the conduit, the force of gravity or a force externally imposed upon the bag to compress it, actuates a flow of soap from the bag through the needle for discharge from the dispenser. As liquid soap is evacuated from the bag, the bag collapses. Upon depletion of the soap, the needle is withdrawn and inserted into a replacement bag of soap.

36 Claims, 1 Drawing Sheet

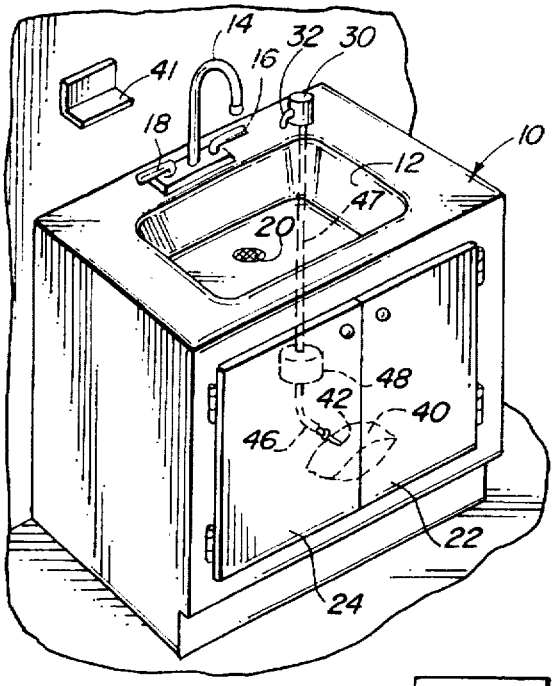
FIG. 1
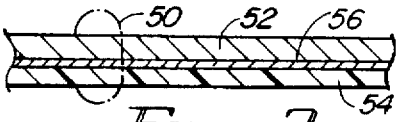
FIG. 3
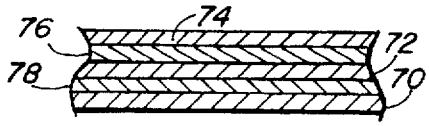
FIG. 7
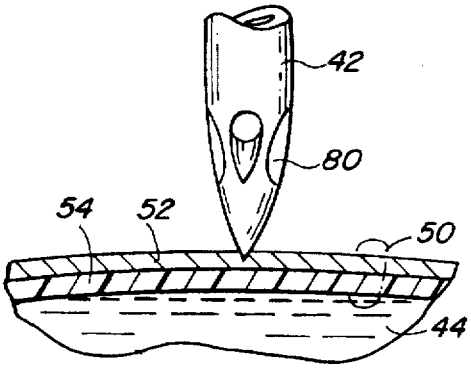
FIG. 4
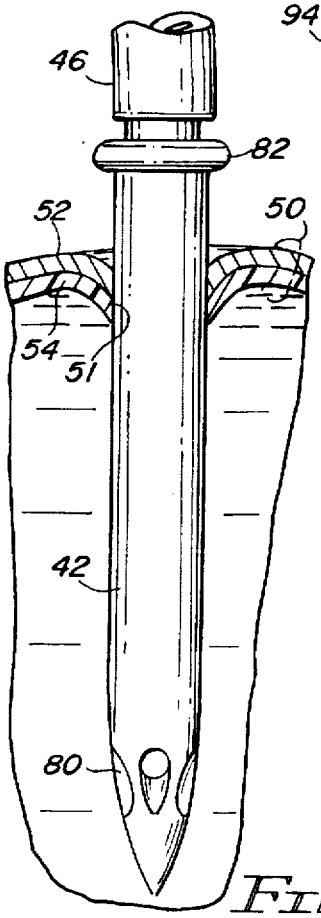
FIG. 5
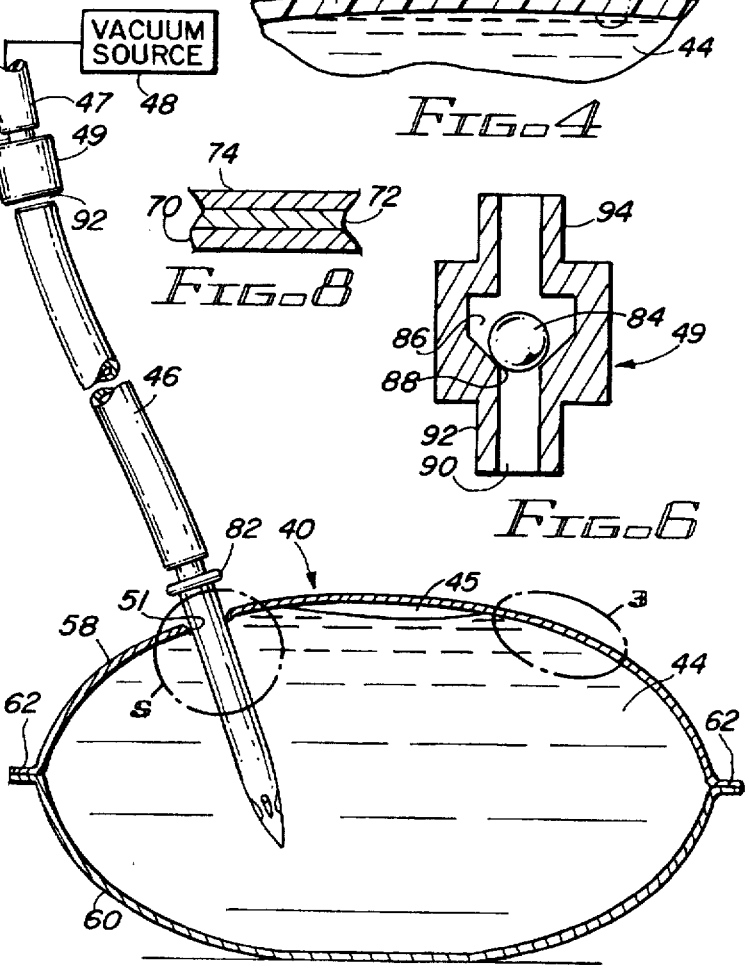
FIG. 2
FIG. 8
FIG. 6

SOAP BAG

BACKGROUND OF THE INVENTION

1. Field of the Invention

The present invention relates to soap dispensers and, more particularly, to collapsible containers for dispensing liquid soap.

2. Description of Related Art

Dispensation of soap at a washbasin is quite common. Usually, such dispensers include a fixed container of liquid soap into which is inserted a plunger having an outlet tube. When a user depresses a knob at the end of a stem associated with the plunger, soap is hydraulically forced from the soap container and through the outlet tube. Periodically, the liquid soap in the container is replenished. The requisite touching of the structure attendant the soap dispenser tends to have the effect of spreading disease as a result of bacteria, viruses and other micro-organisms being transferred to the structure and from the structure to the hands of a subsequent user. For the handicapped or infirm, the required manipulation may be very difficult or impossible and result in a failure to use the soap available and is a potential unnecessary spread of disease.

Various soap dispensers have been used that dispense soap from a flexible bag by squeezing or compacting the soap bag directly or through a lever. Such mechanisms require a certain amount of forceful manipulation that may be beyond the capability of a handicapped or infirm person. Furthermore, the resulting pressurization of the soap bag may cause it to burst, particularly if the mechanism is manipulated with excessive force.

Gravity feed soap dispensers, whether dispensing soap from a rigid or flexible container, have been used. Such devices dispense soap in response to manipulation of a valve mechanism for opening a discharge outlet/tube. The flow rate of such devices is primarily a function of the head pressure and congestion at and about the outlet. As liquid soap has a tendency to form a crust due to evaporation, the size of the outlet may become compromised to prevent any or only an insignificant amount of soap dispensation.

SUMMARY OF THE INVENTION

A bag for dispensing a personal hygiene liquid, such as liquid soap, is constructed from laminated sheets of plastic material forming a sealed container. A sharp hollow needle is penetrably inserted through one of the walls of the container formed by the sheets of material to provide a discharge conduit. A seal about the circumference of the needle is formed during penetration by the gripping action of the sheet material due to stretching and curling of the sheet material adjacent the circumferential surface of the needle. A conduit extending from the needle conveys soap to a discharge outlet in response to an applied source of vacuum. The ambient atmospheric pressure will cause the soap bag to collapse as a function of the source of vacuum and a quantity of liquid soap will be discharged. Discharge may also be effected by using the force of gravity or by an externally applied force to compress the soap bag. When depleted, the soap bag is replaced by simply withdrawing the needle from the soap bag, discarding the soap bag and penetrably inserting the needle into a replacement soap bag.

It is therefore a primary object of the present invention to provide a collapsible liquid soap bag for dispensing soap through a bag penetrating hollow needle and a conduit extending from the needle.

Another object of the present invention is to provide a collapsible bag for liquid soap that automatically forms a seal about a bag penetrating soap discharge hollow needle upon penetration of the needle.

Still another object of the present invention is to provide a liquid soap bag formed from multi-layered sheet material to prevent leakage and chemical reaction with the liquid soap and to form a seal upon penetrable insertion of an hollow needle.

Yet another object of the present invention is to provide a liquid soap bag of multi-layered sheet material having a non-tearing layer to form a seal about a penetrating hollow needle.

A further object of the present invention is to provide a liquid soap bag for sealed penetrable engagement by an hollow needle to dispense soap in response to the force of gravity.

A yet further object of the present invention is to provide a soap dispensing system selectively responsive to a vacuum source for dispensing soap from a closed liquid soap bag through an hollow needle and attached conduit.

A still further object of the present invention is to provide a method for dispensing soap from a liquid soap bag through an hollow needle in penetrable sealed engagement with the bag.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which:

FIG. 1 illustrates a representative wash basin incorporating the present invention;

FIG. 2 is a partial cross-sectional view of the present invention;

FIG. 3 is a detail view taken within dashed circle 3 illustrated in FIG. 2;

FIG. 4 is a partial detail view illustrating initial penetration by a needle of a liquid soap bag;

FIG. 5 is a partial cross-sectional view taken within dashed circle 5 illustrated in FIG. 2;

FIG. 6 illustrates a check valve for preventing return flow of liquid soap;

FIG. 7 illustrates cross-section of a multi-layered sheet material for the soap bag; and FIG. 8 illustrates a cross-section of an extruded multi-layered sheet material for the soap bag.

DETAILED DESCRIPTION OF THE PREFERRED EMBODIMENT

Referring to FIG. 1, there is shown a representative cabinet 10 supporting a wash basin 12. A spigot 14 in combination with handles 16,18 associated with hot and cold water valves are mounted upon cabinet 10 to provide hot and cold water, selectively, through the spigot. The wash basin includes a conventional drain 20. Cabinet doors 22,24 provide access to the interior of cabinet 10 for installation and repair of the plumbing fixtures as well as for storage purposes. A soap dispenser 30 is mounted on cabinet 10 adjacent wash basin 12 to permit a user to receive liquid soap discharged through outlet 32.

Referring jointly to FIGS. 1 and 2, further details attendant the apparatus for dispensing soap will be described. A collapsible container or bag 40 for dispensing liquid soap may be mounted at any convenient location within cabinet 10 or at another location of convenience. For instance, it could be mounted upon shelf 41 above outlet 32 to permit flow of liquid soap to the outlet in response to the force of gravity. An hollow needle 42 is inserted into penetrable engagement with bag 40 to permit egress of liquid soap 44 from within the bag. The bag may include a small air pocket 45 formed during manufacture of the filled bag. A conduit 46 conveys liquid soap from needle 42 to soap dispenser 30 in response to a source of vacuum 48. Alternatively, the bag may be placed at a location permitting flow into and through conduits 46,47 in response to the force of gravity. Alternatively, a compressive force applied to bag 40 may be employed to urge flow into and through conduits 46,47. A check valve 49 precludes flow of liquid soap back into bag 40. The source of vacuum may be an apparatus of any of various configurations and modes of operation. A source of vacuum operable in response to a flow of water discharged through spigot 14 is disclosed in U.S. Pat. No. 5,215,216, incorporated herein by reference. Herein, a flexible membrane divides a cavity into first and second chambers. A flow of water adjacent or proximate a side of the membrane through the first chamber increases the pressure within the first chamber to increase its volume and reduce the volume in the second chamber. The second chamber is disposed intermediate a source of liquid soap and an outlet. Upon cessation of water flow, the volume of the first chamber will decrease and the volume of the second chamber will increase. The resulting periodic changes in volume in the second chamber alternatively reduces the pressure within the second chamber to draw liquid soap thereinto and a subsequent increase in pressure, causes a discharge of the liquid soap from the second chamber through the outlet. Reverse flow of the liquid soap is prevented by use of one or more check valves. Such apparatus has particular utility in combination with the present invention as it requires no source of electrical power and is operated whenever a user performs a washing function at wash basin 12.

A primary commercial benefit through deployment of liquid soap filled bag 40 is that of permitting periodic replacement without incurring spillage of the liquid soap. Furthermore, the liquid soap filled bags can be stored indefinitely in preparation for use at any convenient location. Finally, spillage usually resulting from the filling of prior art soap containers is avoided and spillage of replacement fixed or collapsible prior art liquid soap containers during mechanical attachment to conduits is eliminated.

Referring jointly to FIGS. 2 through 5, details attendant the structure and installation of liquid soap filled bag 40 will be described in detail. The bag is formed of laminated sheet material that may be extruded as a lamination or developed into a laminated structure by adhering one material with another. Alternatively, when new material(s) are developed or become available and suitable for this purpose, a single layer of such material may be employed. Presently, material 50 of bag 40 is formed of an outside layer of polyamide 52 backed by and laminated to an inside layer of polyethylene 54. If necessary, a polyurethane adhesive or other joining material 56 may be disposed intermediate the polyamide and polyethylene layers. Bag 40, as shown in FIG. 2, is formed of two laminated sheets 58,60 joined by a circumscribing seam 62. As represented in FIGS. 4 and 5, the two layers of each sheet (58,60) may be formed by extrusion techniques to develop material 50. It may be noted that material 50 may be formed by an inner lamination of polyethylene which has the requisite properties of being chemically inert to the constituents of the contained liquid soap and sufficiently flexible and resilient to form a seal about a penetrating needle. Moreover, the lamination of polyethylene has heat responsive properties to form a seal along seam 62. As will be discussed hereinafter, the lamination of polyethylene is preferably a non-linear low density polyethylene (LDPE) that has a lower melting temperature than linear low density polyethylene (L-LDPE). Thus, this property is used to advantage to form a seal along seam 62 by applying heat to the area defining the seam. With such heat sealing, no separate adhesive need be used to form the seal at the seam. The outer lamination of polyamide is impermeable to liquid soap. The two laminations are adhered to one another by, for instance, a polyurethane adhesive or otherwise secured to one another. Alternatively, the material (50) may be a single sheet of material having these properties.

Upon penetration of needle 42 into bag 40, it is preferable that a seal 51 therebetween be developed to prevent leakage of liquid soap under normal conditions of use. Furthermore, seal 51 is very important to obtain complete emptying of the bag. With a good seal, a below ambient pressure will be created within the bag by drawing liquid soap from within the bag by either a source of vacuum or by gravity. The below ambient pressure within the bag will cause the ambient pressure external to the bag to collapse the bag and squeeze all of the liquid soap from within the bag.

In the configuration of material 50 illustrated in FIGS. 3, 4, and 5, outer layer of polyamide 52 serves as an impermeable barrier to the liquid soap and provides a protective function to prevent damage during normal handling and storage of the soap bag. Inner layer of polyethylene 54 serves the function of preventing tearing of layer 52 upon initial penetration by needle 42, as depicted in FIG. 4. Upon further penetration of needle 42, layer of polyethylene 54 stretches, rather than tears, to exert circumscribing pressure upon the surface of the needle to develop seal 51 therebetween. As particularly depicted in FIG. 5, there will be a curl over of material 50 inwardly to maintain the material in sealing engagement with the needle. Polyamide layer 52 will remain in contact with needle 42 and polyethylene layer 54 will remain in gripping and sealing contact with the needle, as depicted.

A material particularly useful for use in manufacturing bag 40 is provided by a Scandinavian company named DANISCO, which material is sold under the designation CONOTAINER 45/15/60. The characteristics and description of this material is set forth in the table below.

TABLE

CONOTAINER 45/15/60

| COMPOSITION | VALUE | +/− | UNIT | TEST METHOD |
|---|---|---|---|---|
| 0.045 mm L-LDPE | 41.4 | 2.1 | g/m2 | |
| polyurethane adhesive | 2.0 | 0.5 | g/m2 | |
| 0.015 mm biax. oriented polyamide | 17.1 | 0.9 | g/m2 | |
| polyurethane adhesive | 2.0 | 0.5 | g/m2 | |
| 0.060 mm LDPE/L-LDPE | 55.2 | 2.8 | g/m2 | |
| nominal total weight | 117.7 | 6.8 | g/m2 | DIN 53352 |
| nominal total thickness | 123.0 | 7.1 | micr | |
| PHYSICAL PROPERTIES | | | | |
| bondstrength | 3.0 | 1.2 | N/15 mm | ON STM04 |
| seal strength MD | 34.0 | 10.0 | N/15 mm | DIN 53455 |
| seal strength TD | 30.0 | 10.0 | N/15 mm | DIN 53455 |
| COF dynamic | 0.30 | 0.10 | | BS 2782 |

TABLE-continued

| CONOTAINER 45/15/60 | | | | |
|---|---|---|---|---|
| COMPOSITION | VALUE | +/- | UNIT | TEST METHOD |
| solvent retention | 10.0 | 8.0 | mg/m2 | ASTM F151 |
| puncture resistance | 20.0 | 1.0 | Nmm | ON STM 53 |
| BARRIER PROPERTIES | | | | |
| water vapour transmission *) | 2.8 | 0.30 | g/m2 | DIN 53122 |
| oxygen permeability **) | 36.0 | 7.1 | cm3/m2 | DIN 53380 |
| carbon dioxide permeability **) | 145 | 25 | cm3/m2 | DIN 53380 |

Test conditions: 23 centigrades, 50% relative humidity,
*) during 24 hours, 38 centigrades, 90% relative humidity.
**) during 24 hours, 1 atmosphere, 23 centigrades, 5/95% relative humidity.

The CONOTAINER material includes three layers 70,72, 74 laminated with one another by interleaved films of polyurethane adhesive 76,78, as shown in FIG. 7. The inner layer is a low density polyethylene (LDPE) layer 70 which is chemically inert to the constituents of the liquid soap. The middle layer is a polyamide layer 72 which is impermeable to the liquid soap. The outer layer is a layer of linear low density polyethylene (L-LDPE) 74 which serves the function of protecting the polyamide layer 72. It has a high resistivity to heat. This heat resistivity is of particular benefit during the heating process for sealing with one another the perimeters (seam 62) of the two sheets forming the bag. The inner layers of polyethylene (LDPE) of each of the two sheets forming the bag are adjacent one another. Upon application of heat to the two sheets in proximity to seam 62 during sealing of the bag, the facing layers of (non-linear) low density polyethylene (LDPE) will melt and become heat welded to one another to seal the seam about the perimeter of the bag. The higher melting temperature (heat resistivity) of the outer layers of linear low density polyethylene (L-LDPE) of each of the sheets of the bag will not be affected. Similarly, the respective intermediate layers of polyamide of each of the sheets will remain unaffected. FIG. 8 illustrates the three layers (70,72,74) as part of an extruded sheet not requiring an adhesive to secure the layers to one another.

Referring jointly to FIGS. 2, 5, and 6, further details of the structure will be described. Needle 42 may include one or more inlets 80 to accommodate flow of soap 44 into the hollow needle and thence into conduit 46. A collar 82, or the like, may be formed upon needle 42 to limit the extent of penetration of the needle into bag 40. Check valve 49 may be a conventional one-way valve having a ball element 84 disposed within a cavity 86. The ball will close orifice 88 of passageway 90 in response to a reverse flow of liquid soap into bag 40. Gravity may be used to bias ball 84 toward orifice 88 or a spring may be used for this purpose (as is conventional). Conduit 46 is mounted upon hollow boss 92 and an extension 47 of conduit 46 is mounted upon hollow boss 94.

After bag 40 becomes sufficiently evacuated to prevent further discharge of liquid soap 44, an operator withdraws needle 42 from the evacuated bag. After replacement of the evacuated bag with a filled bag, the operator inserts needle 42 into the replacement bag. Such insertion will form a sealed engagement (seal 51) with bag 40 as described above and illustrated in FIG. 5. If a three layer sheet (see FIGS. 7 and 8) is used, both the inner and outer layers (LDPE and L-LDPE) will grippingly circumscribe and sealingly engage the cylindrical surface of the needle. After withdrawal of needle 42 from bag 40, the resilient nature of material 50 will tend to essentially close the opening formed upon penetration of the needle. Thus, leakage of liquid soap from the essentially evacuated bag is of minimal, if any, concern. From this description, it will be apparent that installation and replacement of liquid soap filled bag 40 is easy to accomplish with minimal likelihood of spillage of liquid soap or of the collection of liquid soap residue at and about the location of the bag.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. Apparatus for dispensing a personal hygiene liquid, said apparatus comprising in combination:

(a) a dispenser having an outlet for discharging the liquid;

(b) a supply of the liquid to be dispensed;

(c) a flexible collapsible bag for housing said supply of liquid;

(d) a hollow needle and attached conduit interconnecting said needle with said outlet of said dispenser for penetrably engaging said bag in fluid communication with the liquid, said needle and attached conduit being moveable in response to movement of said bag.

2. The apparatus as set forth in claim 1 wherein said bag comprises sheet material impermeable to the liquid and including a seal formable by said material about the respective circumference of said needle and said conduit.

3. The apparatus as set forth in claim 2 wherein said sheet material comprises a laminate of at least two layers.

4. The apparatus as set forth in claim 3 wherein one of said layers of said laminate comprises a layer for forming said seal, said seal forming layer being flexible and resiliently stretchable to prevent tearing of said material upon penetration of said material to develop a grip about the respective one of said needle and said conduit to form said seal.

5. The apparatus as set forth in claim 4 wherein said seal forming layer is chemically inert to the liquid.

6. The apparatus as set forth in claim 4 wherein said seal forming layer is a sheet of low density polyethylene (LDPE).

7. The apparatus as set forth in claim 4 wherein another of said layers of said laminate comprises a layer impermeable to the liquid.

8. The apparatus as set forth in claim 7 wherein said impermeable layer is disposed exterior to said seal forming layer.

9. The apparatus as set forth in claim 5 wherein another of said layers of said laminate comprises a layer impermeable to the liquid and disposed exterior of said seal forming layer.

10. The apparatus as set forth in claim 8 wherein said impermeable layer is a sheet of polyamide.

11. The apparatus as set forth in claim 9 wherein said impermeable layer is a sheet of polyamide.

12. The apparatus as set forth in claim 8 wherein said laminate includes a further layer disposed exterior to said impermeable layer.

13. The apparatus as set forth in claim 9 wherein said laminate includes a further layer disposed exterior to said impermeable layer.

14. The apparatus as set forth in claim 12 wherein said seal forming layer is low density polyethylene (LDPE).

15. The apparatus as set forth in claim 13 wherein said seal forming layer is low density polyethylene (LDPE).

16. The apparatus as set forth in claim 12 wherein said further layer is linear low density polyethylene (L-LDPE).

17. The apparatus as set forth in claim 13 wherein said further layer is linear low density polyethylene (L-LDPE).

18. The apparatus as set forth in claim 3 wherein said layers of said laminate are coextruded layers.

19. The apparatus as set forth in claim 3 wherein said layers of said laminate are adhered to one another with a polyurethane adhesive.

20. The apparatus as set forth in claim 1 wherein said needle includes a shoulder for limiting the extent of penetration of said bag by said needle.

21. The apparatus as set forth in claim 1 including a check valve for limiting flow through said conduit to one direction.

22. The apparatus as set forth in claim 1 wherein said needle includes a sharp point for initial penetration of said material and an inlet for receiving the liquid.

23. The apparatus as set forth in claim 1 including a source of vacuum for causing the liquid to be evacuated from said bag and discharged through said outlet.

24. The apparatus as set forth in claim 1 including means for locating said bag relative to said outlet to have the force of gravity cause the liquid to be evacuated from said bag and discharged through said outlet.

25. Apparatus for dispensing a liquid from an outlet of a dispenser, said apparatus comprising in combination:

(a) a flexible, collapsible, sealed bag for containing the liquid, said bag including flexible, stretchable, resilient material comprising a laminate having at least two layers;

(b) a hollow needle having a circumference for penetrable engagement with said bag and a conduit having a circumference and extending from said needle for conveying the liquid from within said bag to the outlet of the dispenser, said needle and attached conduit being moveable in conformance with any movement of said bag; and (c) a seal formed about the penetrably engaged one of said needle and said conduit by at least one of said layers of said material constrictively and retentively engaging the circumference of the respective one of said needle and said conduit.

26. The apparatus of claim 25 wherein one layer of said material is chemically inert to the liquid, is in fluid communication with the liquid and forms said seal.

27. The apparatus of claim 26 wherein another layer of said material is impermeable to the liquid.

28. The apparatus of claim 26 wherein said one layer is of low density polyethylene.

29. The apparatus of claim 27 wherein said other layer is of polyamide.

30. The apparatus of claim 27 including a further layer for forming said seal, said further layer being disposed exterior to said other layer.

31. A method for dispensing liquid from a dispenser, said method comprising the steps of:

(a) containing the liquid in a sealed, flexible, collapsible bag;

(b) inserting at least a part of a hollow needle and attached conduit into penetrable engagement with the bag to provide an outflow of the liquid from the bag;

(c) accommodating movement of the needle and conduit responsive to movement of the bag; and (d) forming a seal about at least one of the needle and the conduit with the material of the bag to prevent leakage of the liquid.

32. The method as set forth in claim 31 wherein said step of forming includes the steps of penetrating the material of the bag with the needle and stretching the material of the bag to curl it adjacent the circumference of the respective one of the needle and the conduit without tearing.

33. The method as set forth in claim 32 wherein the material comprises laminations of sheets of plastic material and wherein said step of stretching is carried out by at least one of the laminations.

34. The method as set forth in claim 31 including the step of limiting flow of liquid soap in one direction during dispensation of the liquid soap.

35. The method as set forth in claim 31 wherein the material comprises laminations of polyamide and low density polyethylene and wherein said step of stretching is carried out primarily by the lamination of low density polyethylene.

36. The method as set forth in claim 35, wherein the material comprises a further lamination of linear low density polyethylene disposed adjacent the lamination of polyamide and wherein said step of stretching is carried out by both of the low density polyethylene lamination and the linear low density polyethylene lamination.

* * * * *